US006764312B2

(12) United States Patent
Ushiro et al.

(10) Patent No.: US 6,764,312 B2
(45) Date of Patent: Jul. 20, 2004

(54) CONNECTOR FOR COUPLING PANELS AND METHOD OF COUPLING PANELS USING THE CONNECTOR

(75) Inventors: Yutaka Ushiro, Yokohama (JP); Katsuyuki Masaki, Yokohama (JP); Yusuke Hamada, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/327,882

(22) Filed: Dec. 26, 2002

(65) Prior Publication Data

US 2003/0124899 A1 Jul. 3, 2003

(30) Foreign Application Priority Data

Dec. 28, 2001 (JP) ..... 2001-402062

(51) Int. Cl.[7] ..... H01R 9/09
(52) U.S. Cl. ..... 439/33
(58) Field of Search ..... 439/63, 188, 944, 439/581, 578, 582, 319, 74, 75, 82, 158, 754, 72.5, 73, 66, 81, 246, 247, 262, 264, 259, 357, 350–356, 358, 201, 157, 131, 680, 287, 544, 545, 549, 553, 502, 567; 200/1, 51.09, 51.1, 283, 250

(56) References Cited

U.S. PATENT DOCUMENTS 5,122,076 A * 6/1992 Pitts ..... 439/352
6,007,361 A * 12/1999 Flachslaender ..... 439/358
6,045,384 A * 4/2000 Norizuki et al. ..... 439/310
6,290,536 B1 * 9/2001 Hwang et al. ..... 439/553
D475,974 S * 6/2003 Ushiro et al. ..... D13/147
D476,955 S * 7/2003 Ushiro et al. ..... D13/147

FOREIGN PATENT DOCUMENTS

JP 2000-260509 9/2000

* cited by examiner

*Primary Examiner*—P. Austin Bradley
*Assistant Examiner*—Phuongchi Nguyen
(74) *Attorney, Agent, or Firm*—Armstrong, Kratz, Quintos, Hanson & Brooks, LLP

(57) ABSTRACT

A connector for coupling panels which does not influence upon an electrically connected part of a connector to be attached to a panel even if an external force is applied to the panel. The connector for coupling panels comprises an insulating housing having a through hole therein through which connector terminals are fitted therein, flanges orthogonal to a direction of insertion and removal through the insulating housing and projected outwardly from at least one wall face of the insulating housing, comprising front and back faces, respectively, and a pair of retainer members having flexibility, fixedly attached to both side ends or both up-down ends of the insulating housing, respectively, wherein the retainer members are provided with a pair of retainer stepped parts, facing each other, and there is a gap for allowing fixture of the panel between the front and back faces of the respective flanges and the respective retainer stepped parts of the retainer members.

13 Claims, 7 Drawing Sheets

CONNECTOR FOR COUPLING PANELS AND METHOD OF COUPLING PANELS USING THE CONNECTOR

FIELD OF THE INVENTION

The invention relates to a connector for coupling panels such as printed wiring panels on which electronic components are mounted, particularly to a connector for electrically and mechanically coupling panels with each other or merely mechanically coupling the panels with each other and a method of coupling two panels with each other in a predetermined spacing using the connector.

BACKGROUND OF THE INVENTION

As various electronic equipment such as duplicating machines, printers, personal computers are diversified and improved in function, the number of electronic components incorporated in these equipment increases, and electronic circuits have been complex. These electronic components are normally mounted on a panel, and mutually electrically connected to one another on the panel. However, as the number of electronic components increases and electronic circuits have been complex, these electronic components can not be mounted on one panel, so they are dispersed and installed on a plurality of panels wherein the electronic components are mutually electrically connected to one another. When a plurality of panels are incorporated in an electronic equipment, respective panels are mechanically connected to one another so as to stack the plurality of panels one another and the electronic components are mutually electrically connected to one another in order to reduce a space occupied by a plurality of panels and to incorporate the plurality of panels efficiently in the electronic equipment.

There has been conventionally in widespread use a method of electrically coupling panels with each other wherein a plug-type connector is fitted in one panel and a receptacle-type connector is fitted in the other panel wherein when both the plug and receptacle are coupled with each other, barrel parts of the respective contacts are butted against each other under pressure. Such a method of connection is, for example, as disclosed in JP-A 2000-260509, known as a panel versus panel type connector system.

FIGS. 7(A) and 7(B) show a connector system as disclosed in JP-A 2000-260509, wherein FIG. 7(A) is a sectional view showing a state before the connectors are coupled with each other, and FIG. 7(B) is a sectional view showing a state after the connectors are coupled with each other.

A connector system 1000 is made up of a first connector 100 and a second connector 200 respectively mounted on a pair of panels 110, 210 in a stacked state.

The first connector 100 includes a plurality of contacts 120 which are disposed in a predetermined pitch. Each of the contacts 120 is pressed into and held by a housing 130. Likewise, the second connector 200 includes a plurality of contacts 220 which are disposed in a predetermined pitch, and each of the contacts 220 is pressed into and held by a housing 230.

When both the first connector 100 and second connector 200 are engaged with each other, respective contacts 120 electrically contact the corresponding respective contacts 220 so that electric conductive condition is achieved between the panel 110 and the panel 210 on which the respective connectors 100 and 200 are mounted.

However, with the panel versus panel type connector system, if an external force is applied to a panel, a stress is applied to a soldered part of the contacts to generate solder crack or the like, causing inferior conduction between both connectors. As measures for preventing this, reinforced pins, reinforced tabs are additionally provided on both the connectors so that even if an external force is applied to both the connector, it does not influence upon the contacts. With the panel versus panel type connector system, a positioning alignment of the connectors is difficult when they are coupled with each other, and contacts of both the connectors and the state of coupling therebetween can not be observed from the outside so that both the contacts undergo permanent deformation or breakage if the connectors are forced to be coupled with each other in a state where a positional displacement occurs, causing an inferior connection.

SUMMARY OF THE INVENTION

The invention has been developed to eliminate the problems described above, and an object of the invention is to provide a connector for coupling panels which does not influence upon an electrically connected part of the connector to be attached to a panel even if an external force is applied to the panel.

It is another object of the invention to provide a connector for coupling panels capable of confirming a state of connection of connectors even after coupling the panels with each other.

It is still another object of the invention is to provide a connector for coupling panels with retainer members capable of easily attaching to and removing from panels.

It is still another object of the invention is to provide a connector for coupling panels with retainer members which is enhanced in spring strength.

It is still another object of the invention is to provide a method of electrically and/or mechanically coupling and connecting two panels with each other easily.

The connector for coupling panels according to the first aspect of the invention comprises an insulating housing with connector terminals fitted therein, flanges orthogonal to a direction of insertion and removal through the insulating housing and projected outwardly from at least one wall face of the insulating housing, comprising front and back wall faces, respectively; and a pair of retainer members having flexibility, fixedly attached to both side ends or both up-down ends of the insulating housing, respectively, characterized in that the retainer members are provided with a pair of retainer stepped parts, and there is a gap for allowing fixture of the panel between the front and back wall faces of the respective flanges and the respective retainer stepped parts of the retainer members.

One of the retainer stepped parts which face each other is inserted into a coupling port of one panel and the other retainer stepped part is inserted into a coupling port of the second panel, whereby the respective panels are engaged in and fixedly attached in the gap defined between the respective retainer stepped parts and the wall faces of the flanges.

The connector terminals preferably employ male and/or female connectors, connectable to other connector removable from either one end or both ends of the insulating housing.

A removably connectable connector is connected to the connector terminals and electric components mounted on each panel are mutually connected to each other through this connector.

Further, the connector terminals are removably fitted in the insulating housing, and holes after removal of the connector terminals can be filled up with a removably connectable stopper, and if electric connection is not needed, the connector terminals are removed from the holes, and the holes after removal of the connector terminals are filled up with a stopper, which can be used for mechanically coupling with the panel.

Further, in other aspect of the invention, the respective retainer members are made up of retainer loops having flexibility, and the respective retainer loops comprise a concave groove provided at the center of an outer wall face opposed to a part of a wall of the insulating housing, to which the respective retainer loops are secured, inclined surfaces provided on both sides of the concave groove, respectively, so as to be inclined outwardly, and retainer stepped parts provided on the respective inclined surfaces.

The retainer loops are formed so as to be substantially uniform in wall thickness or to become smaller in wall thickness towards the concave groove, thereby obtaining flexibility.

The retainer stepped part is preferably made up of a stepped part to be engaged with edges of an opening of an attachment port of the panel, and the stepped part is provided in the form of a step or a plurality of steps on the respective inclined surfaces.

Further, a pair of small flanges with a outer width identical to that of aforesaid flange is preferably formed widthwise at the center of the bottom of the concave groove, and sidewall faces on both outsides of the small flange and sidewall faces on both sides of the aforesaid flange are oriented along the same plane.

Since the retainer loops undergo flexure in flat and pass through the attachment port of the panel when it is inserted into the attachment port, and restore respective original shapes after they passed through the attachment port so that the retainer stepped parts are engaged with the peripheral edge of the attachment port. Since the retainer members are made up of the retainer loops, they function like a double cantilever spring as compared with the conventional panel lock which has been in the form of a cantilever spring, so that concentration of stress can be prevented, and spring strength and spring stability can be enhanced.

A connector for coupling panels according to the second aspect of the invention comprises retainer loops having flexibility, a connecting body for mutually connecting a part of inner walls of the respective retainer loops, flanges projected outwardly from at least one wall face of the connecting body and comprising front and back wall faces, respectively, characterized in that the retainer loops comprises a concave groove provided at the center of an outer wall opposed to a part of the connecting body, to which the respective retainer loops are secured, inclined surfaces provided on both sides of the concave groove, respectively, so as to be inclined outwardly, and a retainer stepped part provided on the respective inclined surfaces, and there is a gap for allowing fixture of the panel between the front and back wall faces of the respective flanges and the respective retainer stepped parts of the retainer members.

The retainer loops are preferably formed so as to be substantially uniform in wall thickness or to become smaller in wall thickness towards the concave groove, thereby obtaining flexibility.

The retainer stepped part is preferably made up of a stepped part to be engaged with edges of an opening of a coupling port of the panel, and the stepped part is provided in the form of a step or a plurality of steps on the respective inclined surfaces.

A pair of small flanges with a outer width identical to that of the aforesaid flange is preferably formed widthwise at the center of the bottom of the concave groove, and sidewall faces on both outsides of the small flange and sidewall faces on both sides of the aforesaid flange are oriented along the same plane.

Since the retainer loops undergo flexure in flat and pass through the attachment port of the panel when it is inserted into the attachment port, and restore respective original shapes after they passed through the attachment port so that the retainer stepped parts are engaged with the peripheral edge of the attachment port. Since the retainer members are made up of the ring-shaped retainer loops, they function like a double cantilever spring as compared with the conventional panel lock which has been in the form of a cantilever spring, so that concentration of stress can be prevented, and spring strength and spring stability can be enhanced.

A method of coupling panels according to the third aspect of the invention comprises the steps of preparing the connector as in the first aspect of the invention, and two panels each provided with a coupling port for fitting the connector therein, and fitting the connector in the coupling port of the panel to couple two panels, thereby connecting the connectors to wiring on both the panels.

A method of coupling panels according to the fourth aspect of the invention comprises the steps of preparing the connector as in the second aspect of the invention, and two panels each provided with a coupling port for fitting the connector therein, and fitting the connector in the coupling port of the panel to couple two panels, thereby connecting the connector to wiring on each panel.

A method of coupling panels according to the fifth aspect of the invention comprises the step preparing the connector as in the first aspect of the invention and the connector as in the second aspect of the inventions and two panels provided with a plurality of coupling ports for fitting both the connectors therein at least one by one, characterized in that both the connectors are fitted in the coupling ports of the two panel to couple two panels, thereby connecting the connector as in the first aspect of the invention to wiring on both the panels.

According to the invention, two panels can be easily electrically and/or mechanically coupled with each other, and these panels can be easily removed from each other. As a result, according to this method of coupling and connecting the panels, electronic components on respective panels is electrically connected with one another by way of the connector, even if an external force is applied to the panels, it does not influence upon a soldered connection part or the like.

BRIEF DESCRIPTION OF THE DRAWINGS

FIGS. 1(A) to 1(D) show a plug-type connector (hereinafter merely referred to as a plug) according to a first embodiment of the invention, wherein FIG. 1(A) is a plan view of the plug, FIG. 1(B) a front view thereof, as seen from the direction of the arrow $Y_1$ in FIG. 1(A), FIG. 1(C) a rear view thereof, as seen from the direction of the arrow $Y_2$ in FIG. 1(A), and FIG. 1(D) a bottom view thereof.

FIGS. 2(A) and 2(B) show the plug in FIG. 1(A), wherein FIG. 2(A) is a side view thereof, as seen from the direction of the arrow X in FIG. 1(A), and FIG. 2(B) is a sectional view thereof, as seen from arrows A—A in FIG. 1(A).

FIGS. 3(A) and 3(B) show a state where the plug is fitted to a panel, wherein FIG. 3(A) is a perspective view showing a state where the plug is attached to the panel from one wall face thereof and FIG. 3(B) is a perspective view showing a state where the plug is attached to the panel from the other wall face thereof.

FIGS. 6(A) and 6(B) show a connector for coupling panels according to a second embodiment of the invention, wherein FIG. 6(A) is a plan view thereof, and FIG. 6(B) is a plan view of a connector which is different in a coupling interval from that shown in FIG. 6(A).

FIGS. 7(A) and 7(B) show a conventional connector, wherein FIG. 7(A) is a sectional view showing a state of the connector before the connector is coupled with each other, and FIG. 7(B) is a sectional view showing a state of the connector after the connector is coupled with each other.

PREFERRED EMBODIMENT OF THE INVENTION

An embodiment of the invention is described hereinafter with reference to the accompanying drawings. It is to be pointed out however that the invention is not limited thereto, and various modifications may be made therein by methods that will be described hereinafter as necessary and structures and functions of such modifications will be easily understood and apparent from the description of the present embodiment, omitting therefore description thereof.

A plug-type connector will be described hereinafter as an electrical connector according to the invention, however, the invention is not limited to the plug-type connector, and is applicable to a receptacle-type connector as well.

Figure 1A:
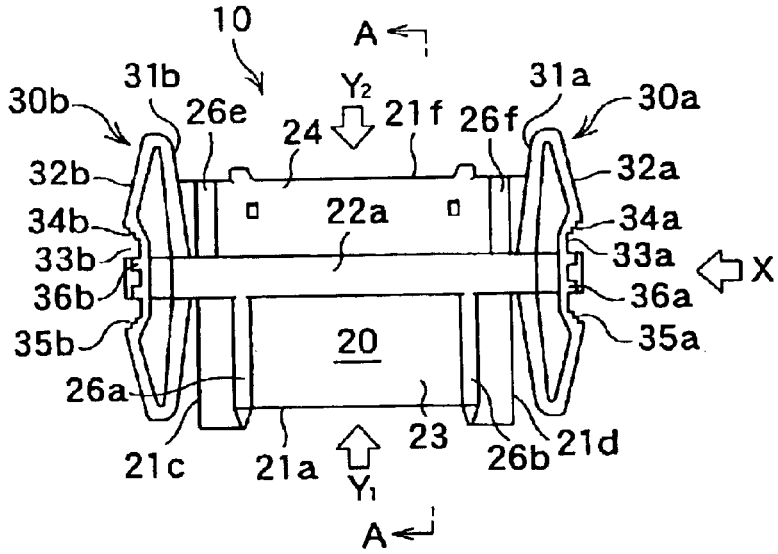
Figure 1B:
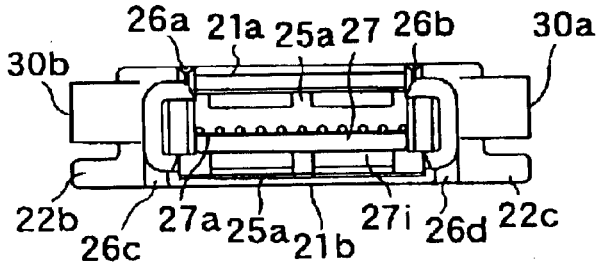
Figure 1C:
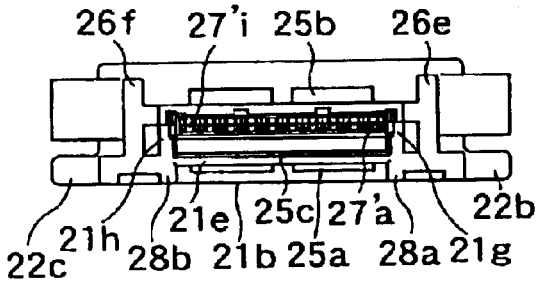
Figure 1D:
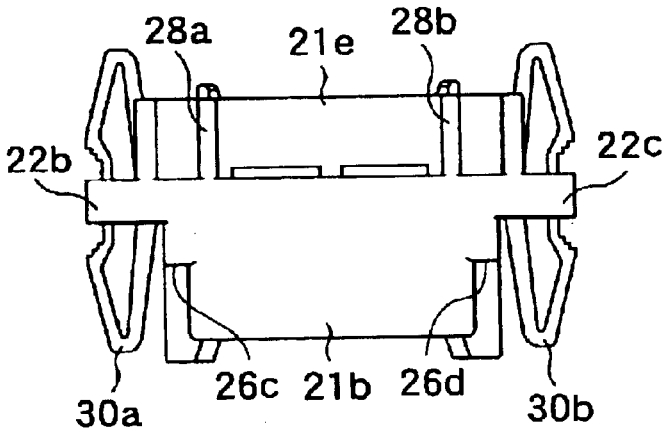
Figure 2A:
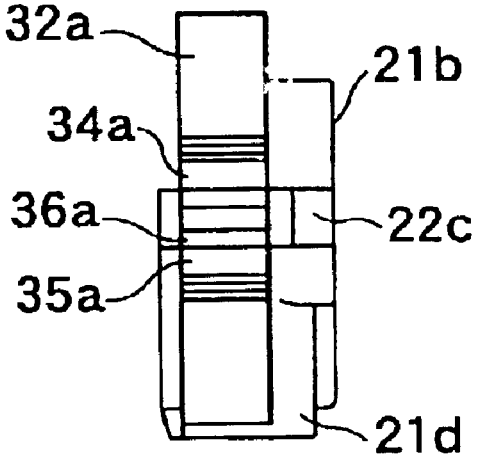
Figure 2B:
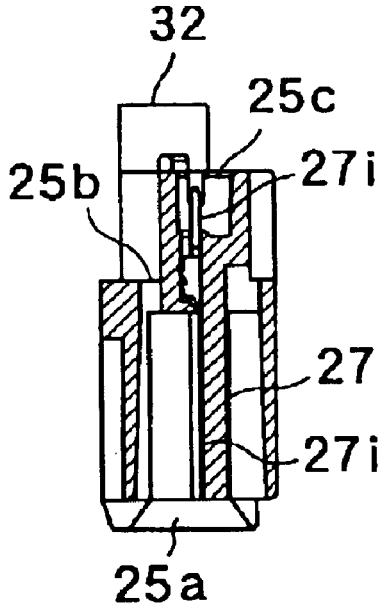

FIGS. 1(A) to 1(D) show a plug connector according to a first embodiment of the invention, wherein FIG. 1(A) is a plan view of the plug, FIG. 1(B) is a front view thereof, as seen from the direction of the arrow $Y_1$ in FIG. 1(A), FIG. 1(C) is a rear view thereof, as seen from the direction of the arrow $Y_2$ in FIG. 1(A), and FIG. 1(D) is a bottom view thereof. FIGS. 2(A) and 2(B) show the plug in FIG. 1(A), and FIG. 2(A) is a side view thereof, as seen from the direction of the arrow X in FIG. 1(A) and FIG. 2(B) is a sectional view thereof, as seen from arrows A—A in FIG. 1(A).

A connector 10 comprises a housing proper 20 in flat block shape, and a pair of retainer loops 30*a*, 30*b*, fixedly attached to both sidewalls of the housing proper 20, respectively, and these components are formed of a synthetic resin material, integrally with each other.

The housing proper 20 is divided at a flange 22*a*, as the boundary, into a front housing 23 extending forward, and a back housing 24 extending backward, and the front housing 23 is slightly longer than the back housing 24.

The flange 22*a* formed on an upper wall face 21*a* of the front housing 23 is made up of vertical walls each projecting vertically and externally, in a predetermined width, from the upper wall face 21*a* of the flat housing, in the direction orthogonal to the direction of the longitudinal axis of housing. Further, on a lower wall face 21*b*, there are formed flanges 22*b*, 22*c*, with a width identical to that for the flange 22*a*, protruded outwardly from both sidewalls 21*c*, 21*d*, respectively, at a position opposite to the flange 22*a*. Further, the front housing 23 comprises a slender through-hole 25*a* into which a receptacle (not shown) can be inserted and to which a plurality of connector terminals are fitted, two ribs 26*a*, 26*b*, protruding in the vicinity of both edges of the upper wall face 21*a*, respectively, and steps 26*c*, 26*d* provided at both edges of the lower wall face 21*b*, respectively. The two ribs 26*a*, 26*b* and the steps 26*c*, 26*d* fulfill a function of positioning at the time of coupling with the receptacle, thereby blocking coupling in a wrong direction. These also fulfill a function of blocking insertion of the connector into a coupling port of a panel, not matching a shape of the front housing 23. That is, because the two ribs 26*a*, 26*b* of the upper wall face 21*a* are formed at different positions, respectively, these ribs will be butted against a peripheral face of the coupling port of the panel in case an attempt is made to fit the connector 10 in an inverted position, thereby preventing insertion thereof in a wrong way.

Further, with the slender through-hole 25*a*, peripheral corners thereof are chamfered, a deck 27 is formed widthwise therein, and a plurality of connector terminals 27*a* to 27*i* are fitted onto the deck 27.

The back housing 24 comprises a slender through-hole 25*b* linked with the slender through-hole 25*a*, two ribs 26*e*, 26*f*, protruded upward from both edges of an upper face wall 21*f*, respectively, two stepped parts 28*a*, 28*b*, protruded from both edges of lower face wall 21*e*, respectively, and a slender hole 25*c* defined by the upper face wall 21*f*, the lower face wall 21*e*, and sidewall faces, 21*g*, 21*h*, on the left and right sides, respectively, and further, inside of the slender hole 25*c*, there are protruded connector pins 27'*a* to 27'*i*, linked with the connector terminals 27*a* to 27*i*, respectively.

The connector terminals 27*a* to 27*i* each are made up of a flat strip-like contact piece and a pin-like terminal linked therewith. FIG. 2(B) shows a state where one of the connector terminals is fitted to the housing. With the use of these connector terminals, other connector (not shown) can be removably coupled with both edges of the through-hole 25*a* and the slender hole 25*c*, respectively.

Further, the connector terminals are not limited in shape to such a shape as described above, and connector terminals in optional shape such as a female connector and/or male connector, (not shown), or the like may be employed.

Still further, these connector terminals may be removably fitted inside the through-hole or the slender hole to be removed when electrical connection is unnecessary, and the holes after removal of the connector terminals can be filled up with a removable stopper (not shown).

A pair of retainer loops 30*a*, 30*b* are fixedly attached to both the right-side and left-side ends of the flange 22*a* of the housing proper 20, respectively. The retainer loops 30*a*, 30*b* are identical in shape. For brevity in description, only one of the retainer loops, 30*a*, is described hereinafter, and as to the other retainer loop 30*b*, parts are denoted by the identical number with a suffix b added thereto, thereby omitting description thereof.

The retainer loop 30*a* is formed substantially in the external shape of a rhombus in a plan view, with space substantially in rhombus-like shape defined therewithin, and is made up of a loop-shaped body having a predetermined width and wall thickness. The retainer loop 30*a* is divided vertically into inner and outer two loop-shaped pieces 31*a*, 32*a*, along a line interconnecting opposite angles of the rhombus-like shape, in the longitudinal direction thereof, and one of the loop-shaped pieces, 31*a*, is relatively large in wall thickness while the other loop-shaped piece 32*a* is formed smaller in wall thickness. Of the loop-shaped pieces 31*a*, 32*a*, obtained by halving the retainer loop 30*a*, the center of the outer wall of the loop-shaped piece 31*a* larger in wall thickness is fixedly attached to the end of the flange 22*a* of the housing proper 20 while a concave groove 33*a* is formed at the center of the loop-shaped piece 32*a* smaller in wall thickness. The retainer loops 30*a*, 30*b* preferably have a length, that is, a length in the longitudinal direction of the rhombus-like shape thereof, respectively, such that the tip thereof is substantially flush with the tip of the front housing 23, and the back housing 24, respectively. Obviously, the length is subject to change to a suitable length depending on dimensions of the housing proper 20 or thickness of the panel to which attachment is to be made.

The concave groove 33*a* is provided with inclined surfaces 34*a*, 35*a*, inclined at a predetermined angle, respectively, on both sides thereof, and a stepped part to be engaged with edges of the opening of a coupling port of a panel is provided in the form of a step or a plurality of steps on the respective inclined surfaces. Further, a pair of small flanges 36*a* with a outer width identical to that of the flange 22*a* is provided at the center of the concave groove 33*a*, and is formed such that outer side faces of the small flanges 36*a* are oriented along the same plane as a plane along which side faces of the flanges 22*a*, 22*b*, 22*c*, respectively, are oriented.

By positioning the side faces of the flanges 22*a*, 22*b*, 22*c*, and 36*a*, respectively, so as to be oriented along the same plane, the panel is butted against the respective flanges upon attaching the plug to the panel, thereby implementing positioning of the plug in the panel. As shown in FIG. 1(A), the small flanges 36 is provided with two rib-like projections with a predetermined spacing therebetween, however, may be provided with one rib-like projection with a predetermined width instead.

As described in the foregoing, both the retainer loop 30*a*, and the retainer loop 30*b* are identical in structure. Also, the respective retainer loops 30*a*, 30*b* can be modified in detailed structure. Further, the respective retainer loops 30*a*, 30*b* have a structure with flexibility while maintaining mechanical strength, and such flexibility can be maintained by reducing the wall thickness of the respective retainer loops, in belt-like form, gradually from a fixed part of a inner wall thereof towards the concave grooves 33*a*, 33*b* or the flexibility and mechanical strength can also be maintained by keeping the wall thickness uniform without varying the same.

Further, the retainer loops 30*a*, 30*b* can be formed in any optional external shape such as an ellipse, a flat block, or the like instead of a rhombus.

Still further, the retainer loops 30*a*, 30*b* maybe fixedly attached to the sidewalls 21*c*, 21*d*, the upper and lower wall faces 21*a*, 21*b* or the peripheral wall faces 21*a* to 21*d*, respectively, in place of the end of the flange 22*a*, on both sides of the housing proper 20. Needless to say, such modification will entail modification in the shape of the housing proper.

Figure 3A:
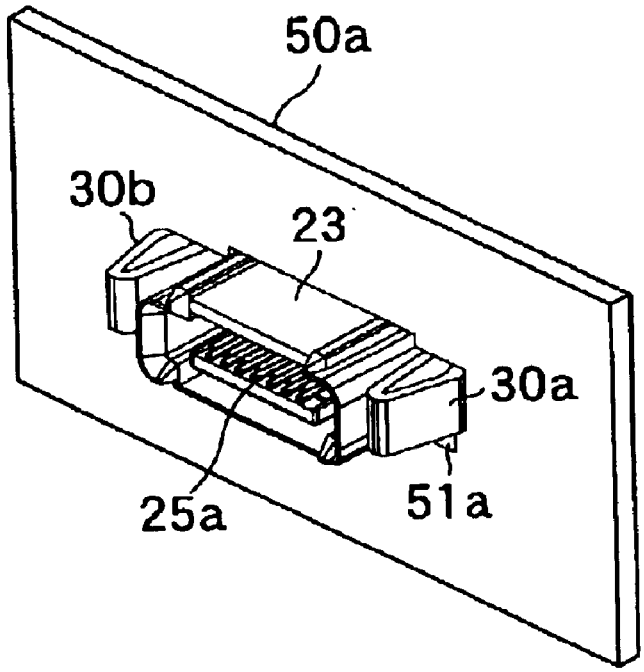
Figure 3B:
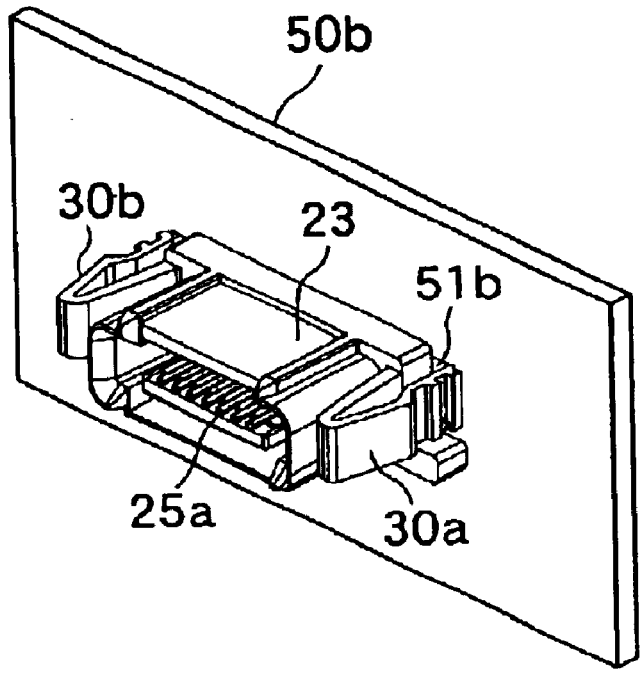
Figure 4:
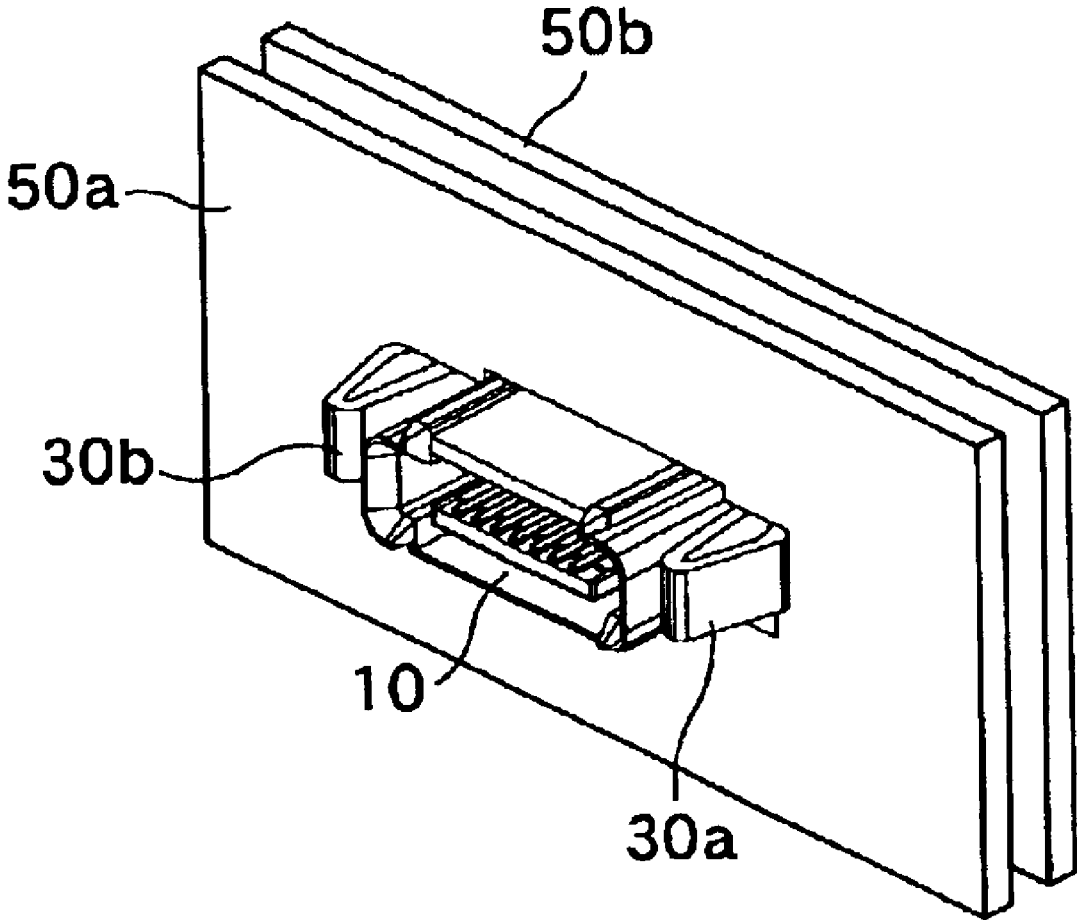
FIG. 4 is a perspective view showing a state where two panels are coupled with each other.

Described next is a method of coupling two panels using the connector for coupling panels. FIGS. 3(A) and 3(B) are enlarged views of a coupling portion between a connector and a panel, wherein FIG. 3(A) is a perspective view showing a state where the connector is fitted in the first panel, and FIG. 3(B) is a perspective view showing a state where the connector is fitted in the second panel. FIG. 4 is a perspective view showing a state where two panels are coupled with each other.

Two panels 50*a*, 50*b* have respectively one or plurality of electronic components (not shown) which are fitted on the faces thereof, and they are electrically connected to each other at back faces thereof by solder or the like.

The coupling ports 51*a*, 51*b* are defined in the panels 50*a*, 50*b* at optional spots, for example, central portions or cornered portions of the panels. The shape of the coupling ports 51*a*, 51*b* are slender holes which conform to the outer shape of the front housing 23 and/or the back housing 24.

(i) Attachment or Removal of First Panel.

The connector 10 is inserted into the coupling port 51*a* while the face of the front housing 23, provided with the pair of ribs 26*a*, 26*b*, facing upwards. Then the extremity of the respective retainer loops 30*a*, 30*b* butted against the opening edge of the long hole of the coupling port 51*a*, and can be inserted thereinto. At this time, the pair of ribs 26*a*, 26*b* of the upper wall face are inserted into the upper grooves of the opening edge, so that the insertion of the front housing 23 is not blocked. When the connector 10 is pushed deeper in, both the loop-shaped pieces 32*a*, 32*b*, smaller in wall thickness and butted against the edges of the opening of the slender hole, respectively, undergo flexure in the direction approaching the housing, so that the space, substantially in the rhombus-like shape, within the retainer loops 30*a*, 30*b*, respectively, is lessened, thereby allowing the retainer loops 30*a*, 30*b* to pass through the coupling ports. Upon the apex of the inclined surfaces 34*a*, 34*b*, respectively, passing through the coupling port 51*b*, the respective retainer loops 30*a*, 30*b* restore respective original shapes by the agency of elastic restoring force. As a result of such restoration of the shapes, one wall face of the panel 50*a* is butted against one wall face of the flange 22*a* while the edge of the coupling port 51*b*, on the other wall face, is retained by the stepped part of the inclined surfaces 34*a*, 35*a*, respectively. The condition of such retainment is as shown in FIG. 3(A).

When an attempt is made to insert the connector 10 into the coupling port 51 with the front housing 23 provided with the pair of ribs 26*a*, 26*b*, in an inverted position, namely being directed downward, the interval between the pair of ribs 26*a*, 26*b* and the width between the ribs 28*a*, 28*b* or the attachment positions of the openings do not accord with the shapes of the openings of the coupling port 51*a*, thereby preventing the connector 10 from being inserted into the coupling port 51*a*.

Further, when an attempt is made to insert the connector with the back housing 24 entering first, the external shape of the a back housing 24 is forced to conform to the coupling port 51*a* or it is reduced to some extent whereby the a back housing 24 can be inserted into the coupling port 51*a*.

In the case of removing the connector 10 from the panel 50*a*, the retainer loops 32*a*, 32*b* of the retainer loops 30*a*, 30*b*, respectively, are pinched and pressed with a thumb and a forefinger thereby cause the retainer loops 32*a*, 32*b* to undergo flexure before removing the connector 10 from the panel 50*a* by pulling the connector 10 out of the panel 50*a* in the direction opposite to the direction of insertion.

(ii) Attachment or Removal of Second Panel.

The connector 10 is inserted into the coupling port 51*b* with the back housing 24 thereof, provided with a pair of the ribs 28*a*, 28*b*, facing downwards. The extremity of the respective retainer loops 30*a*, 30*b* is butted against the edge of the opening of the slender hole of the coupling port 51*b*, thereby enabling insertion of the connector 10. When the connector 10 is pushed deeper in, both the retainer loops 32*a*, 32*b*, smaller in wall thickness and butted against the edges of the opening of the slender hole, respectively, undergo flexure in the direction approaching the housing, so that the space, substantially in the rhombus-like shape, within the retainer loops 30*a*, 30*b*, respectively, is lessened, thereby allowing the retainer loops 30*a*, 30*b* to pass through the coupling port. Upon the apex of the inclined surfaces 34*a*, 34*b*, respectively, passing through the coupling port 51*b*, the respective retainer loops 30*a*, 30*b* restore respective original shapes by the agency of elastic restoring force. As a result of such restoration of the shapes, one wall face of the panel 50*b* is butted against one wall face of the flange 22*a* while the edge of the coupling port 51*b*, on the other wall face, is retained by the stepped part of the inclined surfaces 34*a*, 35*a*, respectively. The condition of such retainment is as shown in FIG. 3(B).

If an attempt is made to insert the connector 10 into the coupling port 51*b* with the back housing 24 provided with the pair of the ribs 28*a*, 28*b*, being directed upward, the ribs 28*a*, 28*b* impinge against a peripheral edge of the coupling port 51*b*, thereby preventing the connector 10 from being inserted into the coupling port 51*b*.

In the case of removing the connector 10 from the panel 50*b*, the retainer loops 32*a*, 32*b* of the retainer loops 30*a*, 30*b*, respectively, are pinched and pressed with a thumb and a forefinger thereby cause the retainer loops 32*a*, 32*b* to undergo flexure before removing the connector 10 from the panel 50*b* by pulling the connector 10 out of the panel 50*a* in the direction opposite to the direction of insertion.

The connector 10 is divided into the front housing 23 and the back housing 24 wherein both housings are different in external shape, and the ribs and the stepped parts on the wall face are formed in different positions. However, the shapes and/or positions of the ribs and stepped parts can be changed optionally in relation to the shape of the coupling ports of the panel. For example, if the shape of the front or back housing is rendered identical or changed, the connector can be fitted in the coupling port in optional shape.

Figure 5:
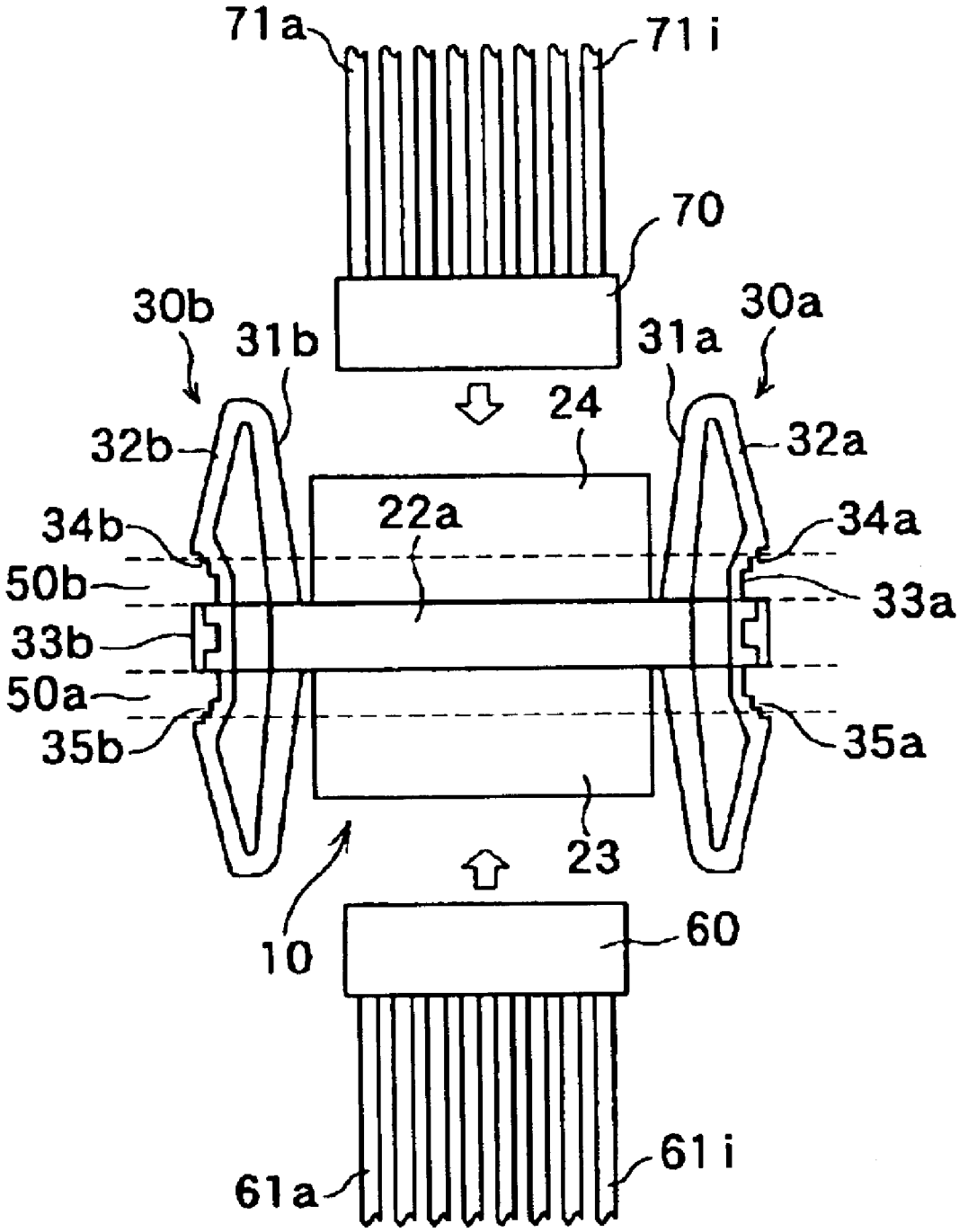
FIG. 5 is a plan view showing a state of electrical connection between the connector and the other connector.

When two panels 50*a*, 50*b* are coupled with each other by the connector 10 according to the method set forth in the above (i), (ii), both the panels are coupled with each other while keeping a predetermined spacing as shown in FIG. 4. The coupled both panels 50*a*, 50*b* are connected to other connector. FIG. 5 is a plan view showing a state of electrical connection between the connector and the other connector.

Two panels 50*a*, 50*b* are coupled with each other by the coupling connector 10. Meanwhile, a plurality of electronic components (not shown) are mounted on respective panels. The electronic components mounted on the panel 50*a* are mutually connected to one another on the same panel by solder while some of the electronic components mounted on the panel 50*a* to be connected to the electronic components (not shown) mounted on the other panel 50*b* are connected to lead wires 61*a* to 61*i* of one connector 60.

The connection of one connector 60 is applied to other connector 70, wherein lead wires 71*a* to 71*i* thereof are connected to the panel 50*b*. When both the connectors 60, 70 are connected to the coupling connector 10, the electronic components on two panels 50*a*, 50*b* are electrically connected to one another by these connectors.

Since the electronic components mounted on both the panels are electrically connected to one another by way of the connectors according to the method set forth in (i), (ii), even if an external force is applied to the panels, such a force does not influence upon the soldered connected part by solder as made in the prior art. Further, since the connection of the connectors is made between the plug-type connector and the receptacle-type connector, it can be easily simplified.

Although the connector 10 is provided with a pair of retainer loops 30*a*, 30*b* at both the right and left side ends of the flange 22*a* of the housing 20, when the retainer loops 30*a*, 30*b* are directly connected with each other, the connector 10 can be used as a connector for mechanically coupling the panels, namely, it can be used as a retainer.

Figure 6A:
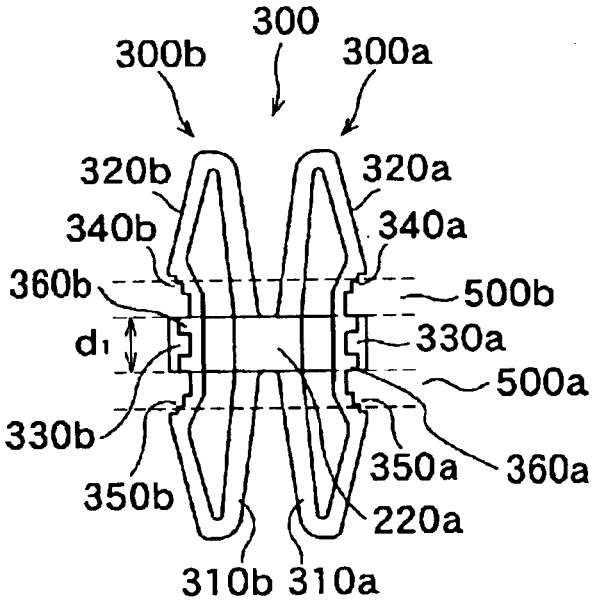
Figure 6B:
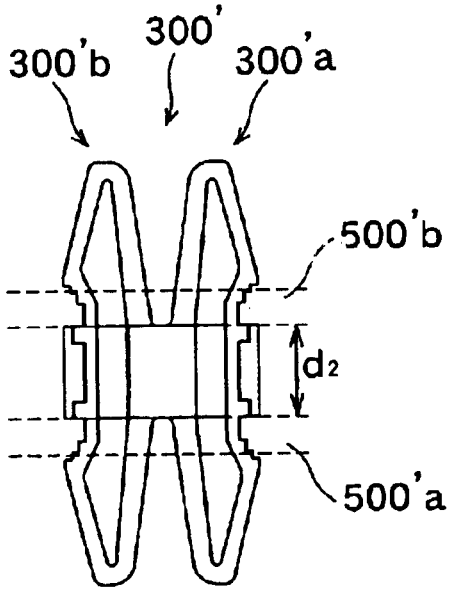
Figure 7A:
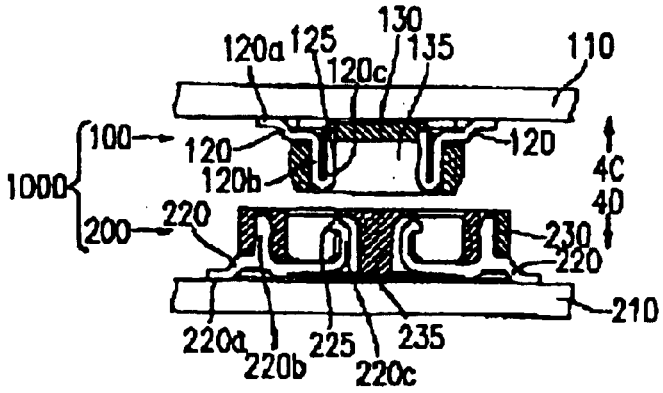
FIG.7(A) PRIOR ART
Figure 7B:
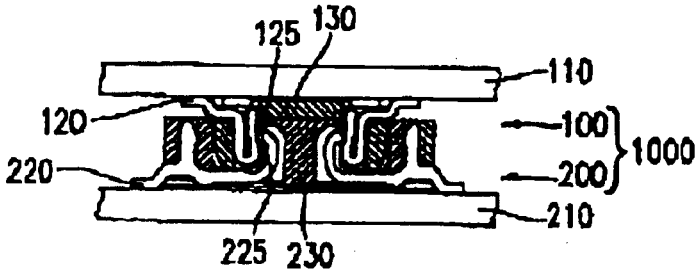
FIG.7(B) PRIOR ART

FIGS. 6(A) and 6(B) show a connector according to a second embodiment of the invention, wherein FIG. 6(A) is a plan view thereof, and FIG. 6(B) is a plan view of a connector which is different in a coupling interval from that shown in FIG. 6(A).

Connectors 300, 300' comprise a pair of retainer loops 300*a*, 300*b*, and a connecting body 220*a* for connecting both the retainer loops 300*a*, 300*b*, and they are formed of a synthetic resin material, integrally with each other.

The retainer loops 300*a*, 300*b* each have the same structure as the retainer loops 30*a*, 30*b*. The structure and function of loop-shaped pieces 310*a*, 310*b*, recessed grooves 330*a*, 330*b*, inclined surfaces 340*a*, 350*a*, 340*b*, 350*b*, and small flanges 360*a*, 360*b* for constituting the retainer loops 300*a*, 300*b* are identical with those of the loop-shaped pieces 31*a*, 31*b*, recessed grooves 33*a*, 33*b*, retainer stepped parts 34*a*, 35*a*, 34*b*, 35*b*, and small flanges 36*a*, 36*b* for constituting the retainer loops 30*a*, 30*b*. The retainer loops 300*a*, 300*b* can be easily understood from the description of the retainer loops 30*a*, 30*b*, and hence a detail description thereof is omitted.

A pair of retainer loops 300*a*, 300*b* are connected with each other at the central portions of the loop-shaped pieces 310*a*, 310*b*, larger in wall thickness by the connecting body 220*a*. The flanges 220*a* are formed on the upper and lower surfaces of the connecting body 220*a*. The flanges 220*a*, 360*a* have a predetermined width d, wherein one flange 220*a* is extended laterally.

Panels 500*a*, 500*b* are retained by the wall faces of both flanges and respective retainer stepped parts (inclined surfaces 340*a*, 340*b*, 350*a*, 350*b*) as shown by dotted lines in FIG. 6(A).

A method of retaining panels is the same as a method of coupling the panels 50*a*, 50*b* using the connector 10. In this case, attachment ports (not shown) of the panels 500*a*, 500*b* may be identical with or different from each other in shape.

An interval between the panels 500*a*, 500*b* is determined by the width $d_1$ of the flanges 320*a*, 320*b* constituting the coupling body. Accordingly, the connector having a determined spacing is formed by changing the width d1 of the flanges for determining the interval between the panels. For example, if an attempt is made to render the width of the flanges large, a width $d_2$ ($d_1<d_2$) is selected, thereby forming a retainer loop 300' having the width $d_2$. The structure of the retainer loops 300*a*', 300*b*' are the same as that of the retainer loops 300*a*, 300*b* of the connector 300.

With the connector for coupling panels having the structure set forth above, even if an external force is applied to the panel to which the connector is attached, it does not influence upon the electrically connected part. Since the retainer members are made up of the ring-shaped retainer loops, they function like a double cantilever spring as compared with the conventional panel lock which has been in the form of a cantilever spring, so that concentration of stress can be prevented, and spring strength and spring stability can be enhanced.

Further, it is possible to confirm a state of connection of connectors even after it is coupled with the panels. Still further, panels can be easily attached to or removed from the connector. More still further, two panels can be electrically and/or mechanically easily coupled with, and connected to each other.

What is claimed is:

1. A connector for coupling panels comprising:

an insulating housing with connector terminals fitted therein;

flanges orthogonal to a direction of insertion and removal through the insulating housing and projected outwardly from at least one wall face of the insulating housing, comprising front and back wall faces, respectively; and a pair of retainer members having flexibility, fixedly attached to both side ends or both up-down ends of the insulating housing, respectively, wherein the retainer members are provided with a pair of retainer stepped parts, facing each other, and whereby there is a gap for allowing fixture of the panel between either one of the flange faces and the respective retainer stepped parts of the retainer members; wherein the respective retainer members are made up of ring-like retainer loops having flexibility, and the respective retainer loops comprise a concave groove provided at the center of an outer wall face opposed to a part of a wall of the insulating housing, to which the respective retainer loops are secured, inclined surfaces provided on both sides of the concave groove, respectively, so as to be inclined outwardly, and retainer stepped parts provided on the respective inclined surfaces.

2. The connector for coupling panels according to claim 1, wherein the connector terminals are male and/or female connectors, connectable to other connectors freely removable from either one end or both ends of the insulating housing.

3. The connector for coupling panels according to claim 2, wherein the connector terminals are removably fitted in the insulating housing.

4. The connector for coupling panels according to claim 1, wherein the retainer loops are formed so as to be substantially uniform in wall thickness or to become smaller in wall thickness towards the concave groove, thereby obtaining flexibility.

5. The connector for coupling panels according to claim 1, wherein the retainer stepped part is made up of a stepped part to be engaged with edges of an opening of a coupling port of the panel, and the stepped part is provided in the form of a step or a plurality of steps on the respective inclined surfaces.

6. The connector for coupling panels according to claim 1, wherein a pair of small flanges with a outer width identical to that of aforesaid flange is formed widthwise at the center of the bottom of the concave groove, and front and back faces of the small flanges and both side faces of aforesaid flange are oriented along the same plane.

7. A method of coupling panels comprising the step of preparing the connector as in any of claims 2 to 6, and two panels each provided with a coupling port for fitting the connector therein; and fitting the connector in the coupling port of the panel to couple two panels, thereby connecting the connector to wiring on both the panels.

8. A connector for coupling panels comprising ring-shaped retainer loops having flexibility, a connecting body for mutually connecting a part of inner walls of the respective retainer loops, flanges projected outwardly from at least one wall face of the connecting body and comprising front and back wall faces, respectively, wherein the retainer loops comprises a concave groove provided at the center of an outer wall opposed to a part of the connecting body, to which the respective retainer loops are secured, inclined surfaces provided on both sides of the concave groove, respectively, so as to be inclined outwardly, and a retainer stepped part provided on the respective inclined surfaces, and there is a gap for allowing fixture of the panel between wall faces of the respective flanges and the respective retainer stepped parts of the retainer members.

9. The connector for coupling panels according to claim 8, wherein the retainer loops are formed so as to be substantially uniform in wall thickness or to become smaller in wall thickness towards the concave groove, thereby obtaining flexibility.

10. The connector for coupling panels according to claim 9, wherein each retainer stepped part is made up of a stepped part to be engaged with edges of an opening of a coupling port of the panel, and the stepped part is provided in the form of a step or a plurality of steps on the respective inclined surfaces.

11. The connector for coupling panels according to claim 8, wherein a pair of small flanges with a outer width identical to that of aforesaid flange is formed widthwise at the center of the bottom of the concave groove, and sidewall faces on both out sides of the small flanges and sidewall faces on both sides of aforesaid flange are oriented along the same plane.

12. A method of coupling panels comprising the step of preparing the connector as in any of claims 8 to 11, and two panels each provided with a coupling port for fitting the connector therein; and fitting the connector in the coupling port of the panel to couple two panels, thereby connecting the connector to wiring on each panel.

13. A method of coupling panels comprising the step of preparing a plurality of the connector as in any of claims 2 to 11, and two panels provided with a plurality of coupling ports for fitting both the connectors therein at least one by one;

fitting both the connectors in the coupling ports of the two panels to couple the two panels, thereby connecting the connector to wiring on both the panels.

* * * * *